US005582323A

United States Patent [19]

Kurtenbach

[11] Patent Number: 5,582,323

[45] Date of Patent: Dec. 10, 1996

[54] MEDICATION DISPENSER AND MONITOR

[75] Inventor: Larry O. Kurtenbach, Dubuque, Iowa

[73] Assignee: United Home Technologies, Inc., Dubuque, Iowa

[21] Appl. No.: 340,643

[22] Filed: Nov. 16, 1994

[51] Int. Cl.[6] ..... G07F 11/00

[52] U.S. Cl. ..... 221/2; 221/82

[58] Field of Search ..... 221/2, 3, 7, 9, 221/13, 15, 82; 364/479, 413.02

[56] References Cited

U.S. PATENT DOCUMENTS

| | | | |
|---|---|---|---|
| D. 328,133 | 7/1992 | Kaufman et al. | D24/186 |
| 4,047,635 | 9/1977 | Bennett, Jr. | 221/5 |
| 4,117,952 | 10/1978 | Grimes | 221/5 |
| 4,204,611 | 5/1980 | Graves | 221/2 |
| 4,223,801 | 9/1980 | Carlson | 221/3 |
| 4,237,344 | 12/1980 | Moore | 179/2 |
| 4,524,243 | 6/1985 | Shapiro | 179/2 |
| 4,763,810 | 8/1988 | Christiansen | 221/3 |
| 4,838,275 | 6/1989 | Lee | 128/670 |
| 4,838,453 | 6/1989 | Luckstead | 221/2 |
| 4,933,873 | 6/1990 | Kaufman et al. | 364/513.5 |
| 4,953,745 | 9/1990 | Rowlett, Jr. | 221/5 |
| 5,036,462 | 7/1991 | Kaufman et al. | 364/413.01 |
| 5,047,948 | 9/1991 | Turner | 221/2 |
| 5,084,828 | 1/1992 | Kaufman et al. | 364/479 |
| 5,102,008 | 4/1992 | Kaufman et al. | 221/25 |
| 5,126,957 | 6/1992 | Kaufman et al. | 364/479 |
| 5,142,484 | 8/1992 | Kaufman et al. | 222/638 |
| 5,148,944 | 9/1992 | Kaufman et al. | 221/131 |
| 5,176,285 | 1/1983 | Shaw | 221/82 |
| 5,197,632 | 3/1993 | Kaufman et al. | 221/197 |
| 5,230,441 | 7/1993 | Kaufman et al. | 221/25 |
| 5,237,602 | 8/1993 | Lazik | 379/38 |
| 5,267,174 | 11/1993 | Kaufman et al. | 364/479 |
| 5,329,459 | 7/1994 | Kaufman et al. | 364/479 |
| 5,335,816 | 8/1994 | Kaufman et al. | 221/13 |

OTHER PUBLICATIONS

The Wall Street Journal, Mar. 25, 1992, p. B1.

Bond and Hussar, *Detection methods and strategies for improving medication compliance,* AJHP vol. 48, pp. 1978–1988 (1991).

*Is noncompliance with outpatient Rx therapy common?,* Drug Topics, vol. 135, p. 30(2), (Sep. 23, 1991).

"Forget Your Pills Lately?" CompuMed® Advertisement (1 page).

Product Report PERS, AARP vol. 2, No. 1 (8 pages).

Haynes, Sackett, Taylor, How to detect and manage low patient compliance in chronic illness, (1 page).

Tel–Lert™—Model O.T.A.—187, One Touch America (2 pages).

*Primary Examiner*—Kenneth Noland

*Attorney, Agent, or Firm*—Zarley, McKee, Thomte, Voorhees, & Sease

[57] ABSTRACT

A medication dispensing and monitoring system of the present invention includes a housing containing a plurality of pill dispensing compartments for dispensing medication to a patient at a desired time. The invention is programmed to dispense medication at the desired time and activates alarms if the proper procedure is not completed. The invention also contacts the emergency personnel through phone lines and initiates two-way hands free communication between the patient and emergency personnel. The invention further includes a pendent transmitter worn by the patient to contact emergency personnel.

25 Claims, 9 Drawing Sheets

A
RTCC
SERVO
SW2
SW1
PIC1-IN
PIC1-OUT
PIC16C54/6
VCC
OSC1
RA0-RA3
OSC2
MCLR
RB0-RB7
13-6
RTCC
GND
4.0 MHZ
.1
15pF
15pF
VCC
4.7K
374K
VDD
ST/GT
EST
D3-D0
17-14
IRQ
RD
RSO
IN+
IN-
GS
VREF
VSS
OSC1
OSC2
TONE
WR
CS
MT8888
100K
100K
100K
60K
37.5K
.001
3.58 MHZ
10K
.001
DTMF
TIP
RING
SDO
SCLK
I/O
RST
IRQ
RD
WR
CS
SDI
C1
C2
C3
RTCC
RA3-RA0
9-6
RB7-RB0
17-10
RC7-RC0
25-18
D7-D0
PIC16C55/57
VCC
OSC1
OSC2
MCLR
RTCC
GND
4.0 MHZ
.1
15pF
15pF
VCC
1N4001
1N4001
BT 1
3.6 VDC
LITHIUM
SCLK
I/O
RST
VCC
SCLK
I/O
RST
NC
X1
X2
GND
DS1202
32.768 MHZ
SDO
SDI
MX 232
232IN
232OUT
SDO
SDI
VCC
JP1
RS232

DISP 1
D7SEGDISP
DISP 2
D7SEGDISP
4511
DIGIT 1
DIGIT 2
DIGIT 3
DIGIT 4
VCC
LT
BI
LE
DIGIT 4
DIGIT 3
DIGIT 2
DIGIT 1
PIC1-OUT
CO
RESPLED
TRBLED
PM
SOUNDER
OH
RSO
PIC1-IN
PFAIL
RESP
AWAY
TRAY
CABNET
RF
RING
Q8-Q1
D8-D1
74HC573
74HC541
D7-D0
C1
C2
C3
A

MEDICATION DISPENSER AND MONITOR

BACKGROUND OF THE INVENTION

1. Field of the Invention

The present invention relates to a medication dispensing and monitoring system. More particularly, the present invention relates to a system that is processor controlled, is linked via a communication line to a central 24 hour nationwide monitoring center, and has a means to receive a signal from a pendent carried by the patient.

2. Problems in the Art

A long recognized problem in the health care industry is the medication non-compliance of patients. If prescribed medication is not taken at the right time, or is not taken in the proper dosage, or it is not taken at all, the prescribed medicine will not have the intended affects which can be dangerous or even fatal if not accurately monitored or controlled. Medication non-compliance is especially a problem with elderly and mentally ill patients. Some other patients are just not that concerned about taking the proper dosage of medication at the proper time and only take it when they think of it. Approximately one-third of the people over 65 who are admitted into hospitals are admitted due to medication non-compliance. Similarly, nearly half of the people entering nursing homes enter for the reason that they do not comply with medication requirements. So it can be seen that medical non-compliance places a huge burden on society, not only in the costs involved, but also in lives. The benefits of a medication dispensing and monitoring system is very apparent.

Common methods of assessing and detecting patient non-compliance are usually no better than guess work. The ideal method of detecting patient non-compliance would be direct observation of the patient, although this is impractical. Prior art detection methods include measures such as self-recording, patient interviewing, pill counting, and medication refilling rates. Some other prior art methods of detecting patient non-compliance are direct supervision of the patient. Supervision of a patient is very costly, however, so therefore, it is not always a practical solution. Other people have tried using phone calls to remind the patient when it is time to take their medication. This is also very burdensome to the care giver.

Other prior art methods of detecting patient non-compliance include using a computerized compliance dispenser. These are probably the most reliable of the prior art non-compliance monitors. One problem with the computerized compliance monitors is that once a non-compliant patient is found, some time has passed since the non-compliance took place.

OBJECTS OF THE INVENTION

A general object of the present invention is to provide a medication dispensing and monitoring system.

It is another object of the present invention to provide a medication dispensing and monitoring system with audio and visual indicators indicating when the patient is supposed to take prescribed medication.

It is another object of the present invention to provide a medication dispensing and monitoring system that alerts a centralized monitoring station when a non-compliance act has occurred.

It is another object of the present invention to provide a medication dispensing and monitoring system which simplifies the process of taking of medication for the patient.

It is another object of the present invention to provide a medication dispensing and monitoring system that has the ability to record events such as compliance and non-compliance.

It is another object of the present invention to provide a medication dispensing and monitoring system having a computer processor which can be programmed directly or remotely by a care giver or other health care provider.

It is another object of the present invention to provide a medication dispensing and monitoring system that includes a means for communicating with a remote patient via an RF transmitter and receiver.

These as well as other objects of the present invention will become apparent from the following specifications and claims.

SUMMARY OF THE INVENTION

A medication dispensing and monitoring system of the present invention is comprised of a dispensing device that can be programmed either by direct connection to a computer through an RS232 port or by connection to a remote computer through a telephone line.

The present invention includes a plurality of pill dispensing compartments which can be loaded by a doctor, pharmacist, or anyone else, with a predetermined amount of medication. The amount of medication required by the patient per dose is loaded into each individual compartment. The device is programmed to dispense each pill dispensing compartment at a predetermined time corresponding to the time in which the patient is supposed to take the medication. The dispensed medication is received by a tray providing access to the patient. If the patient does not open the tray, audio and visual alarms are activated. In addition, the processor initiates a communication with a central monitoring station through the phone lines to notify the station of the non-compliance.

The device of the present invention also includes a built-in speaker phone for two-way hands-free communication with the central monitoring system, medical personnel, etc. The device also has a digital display for displaying various information to the patient including the time of day.

The medication dispensing and monitoring device of the present invention activates alarms for various other situations as well. These situations include a failure of internal self tests, a loss of primary and secondary power, a mechanical malfunction, a failure of internal memory checks, failure of the patient to complete the dispense procedure, or the patient activating the pendant transmitter.

The present invention includes a radio receiver for receiving a signal from a pendant sized transmitter in the possession of the patient. The transmitter allows the patient to press a button on the transmitter which causes the device to signal the monitoring center that an emergency has occurred. This in turn initiates two-way hands-free voice communication between the monitoring center personnel and the patient through the speaker phone.

The medication dispensing and monitoring device is controlled by two programmable processors. One of the microprocessors controls a servo mechanism which causes the pill dispensing compartments to dispense medication at the appropriate times. The second microprocessor is used to manage the display, the communication routines, and other general housekeeping functions of the device. The device has the capability of being programmed and reprogrammed either by a remote computer connected through the phone lines or through a direct connection to the device through the RS232 serial port.

BRIEF DESCRIPTION OF THE DRAWINGS

FIGS. 6–9 show the drive mechanism for the pill dispensing compartments.

DETAILED DESCRIPTION OF THE PREFERRED EMBODIMENT

The medication dispensing and monitoring system of the present invention will be described as a preferred embodiment. It is not intended that the present invention be limited to the described embodiment. On the contrary, it is intended that the invention cover all alternatives, modifications, and equivalences which may be included within the spirit and scope of the invention.

Figure 1:
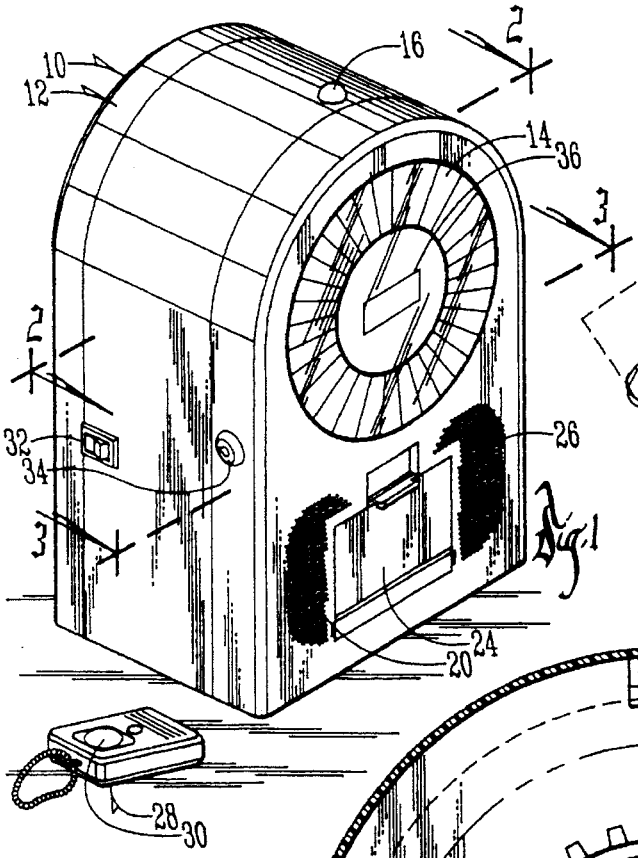
FIG. 1 shows the medication dispensing and monitoring device of the present invention including the pendant transmitter.

FIG. 1 shows the preferred embodiment of the medication dispensing and monitoring system 10 of the present invention. In its preferred embodiment, the medication dispensing and monitoring system 10 includes a housing 12 having 31 pill dispensing compartments 14. The pill dispensing compartments 14 are in a vertical carousel-type arrangement at the front of the housing 12. Each compartment corresponds to a single dosage required for a specific patient at a specific time. The pill dispensing compartments 14 can be filled by pharmacists or other medical personnel. The pill dispensing compartment carousel can be removed as a whole from the device and replaced with another pre-filled carousel or refilled itself.

Figure 6:
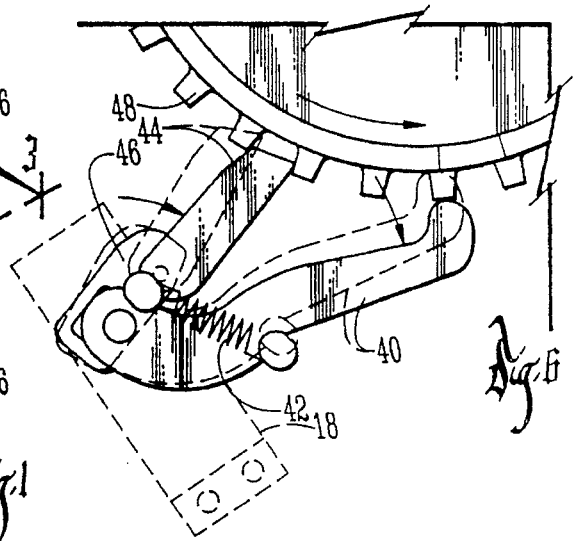
Figure 7:
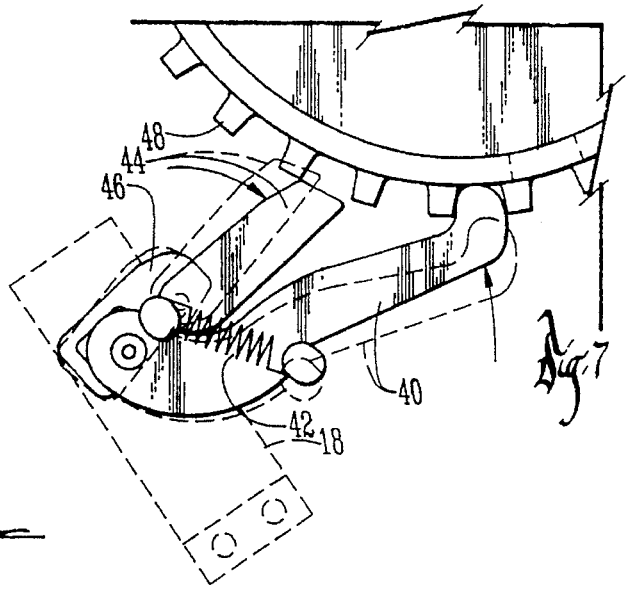
Figure 3:
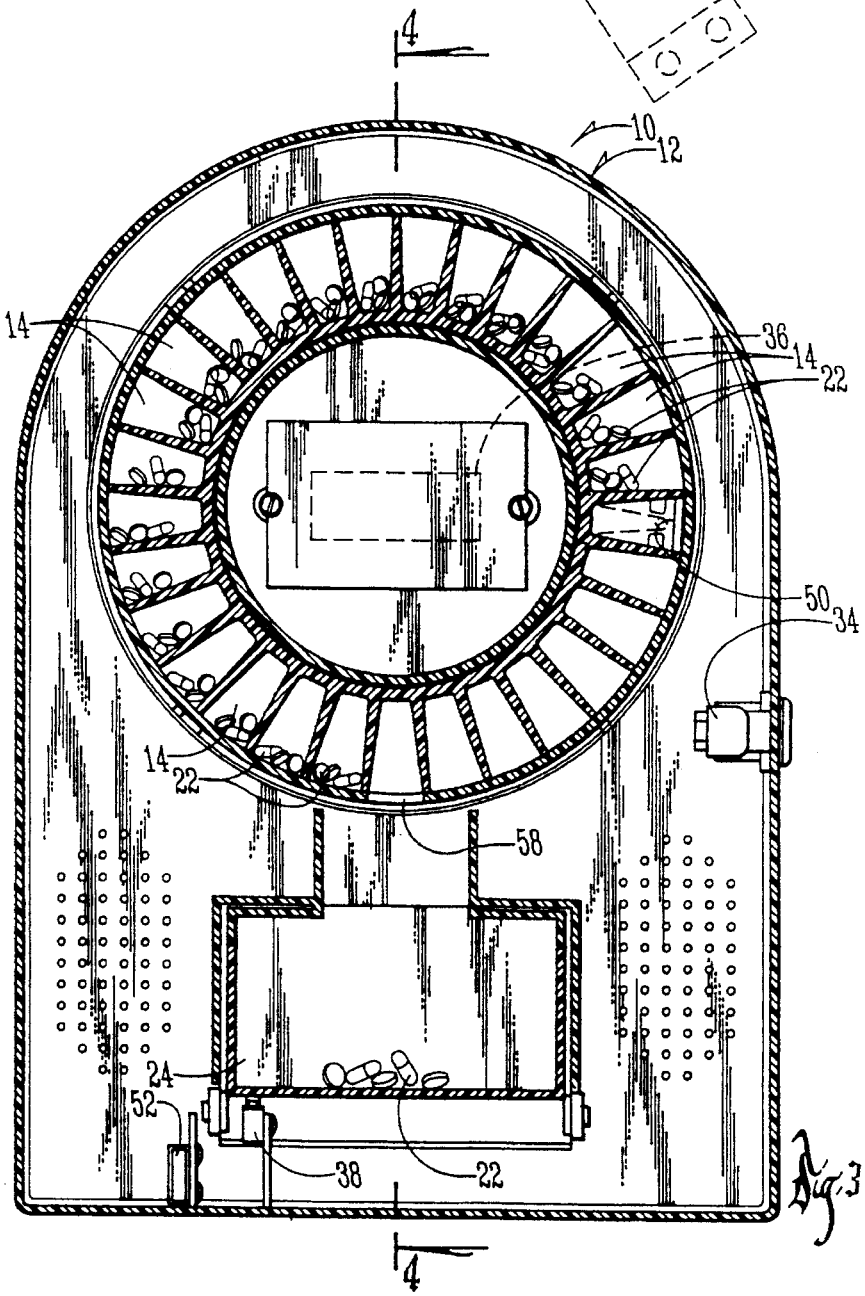
FIG. 3 shows another rear cutaway view of the medication dispensing and monitoring device of the present invention.
Figure 8:
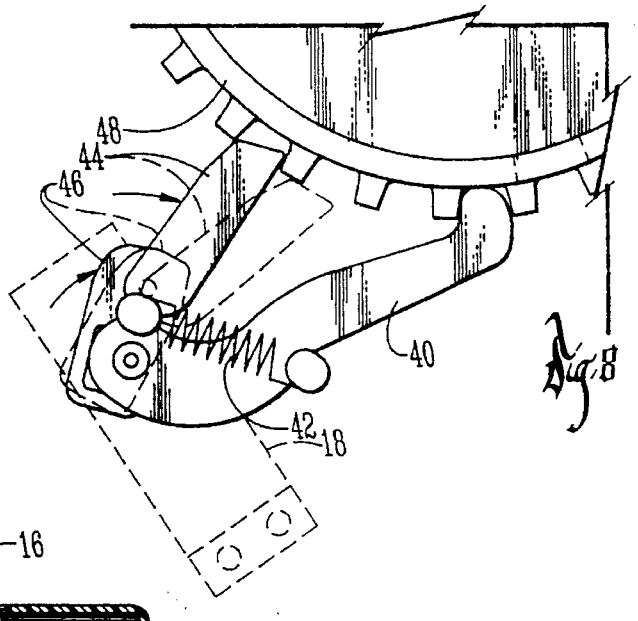

The medication dispensing and monitoring system 10 operates in the following manner and as shown on the Flow Chart in FIG. 10. At a predetermined time as programmed, a visual and audio alarm is activated, indicating to the patient that a dosage should be taken. The visual alarm consists of a red light built into a push-button 16 placed on the top of the housing 12 of the device. The audio alarm consists of a speaker 20 on the front of housing 12. The patient then presses the button 16 on top of the housing 12 which switches micro switch 54, which in turn activates a servo mechanism 18 and causes one of the pill dispensing compartments 14 to dispense the medication 22 contained within it. FIGS. 6–8 illustrate how the servo mechanism 18 causes the pill dispensing compartments 14 to dispense the medication 22. When the processor activates the servo mechanism 18, a servo arm 46 rotates in a clockwise direction causing drive arm 44 to push against the drive gear 48 of the pill dispensing compartments 14 causing the drive gear 48 to move in a counter-clockwise direction. As shown in FIG. 6, as the drive gear 48 rotates, the lock arm 40 gets pushed out to the position shown with solid lines. As shown in FIG. 7, after the drive gear 48 rotates a sufficient distance, drive spring 42 biases lock arm 40 back to its original position. At this time, the servo mechanism 18 rotates the servo arm 46 counter-clockwise back to its original position. As shown in FIG. 8, the drive arm 44 then moves back to its original position. In this way, the servo mechanism can advance the medication dispensing compartments 14 the proper distance to dispense one compartment 14 at a time.

Figure 2:
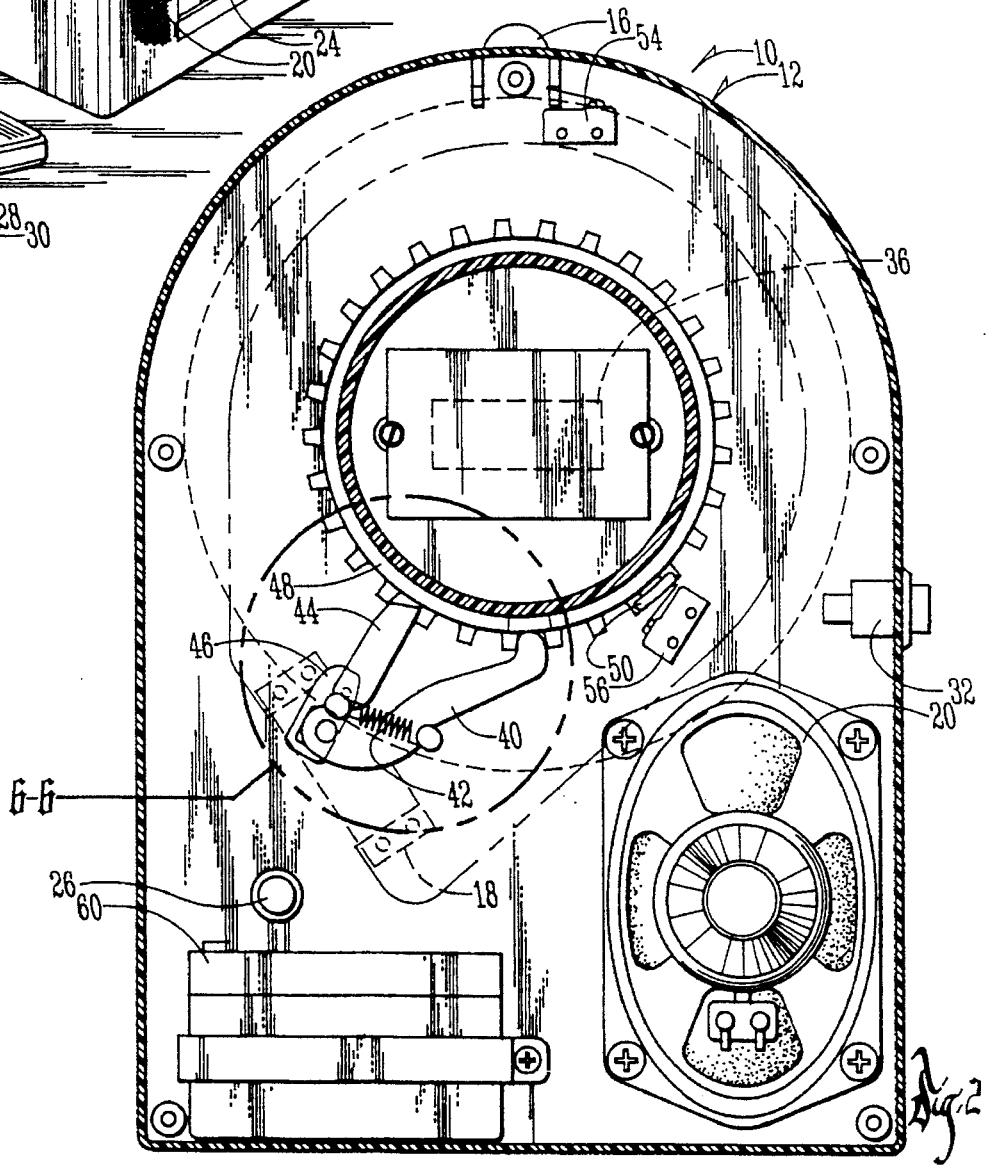
FIG. 2 shows a rear cutaway view of the medication dispensing and monitoring device of the present invention.
Figure 4:
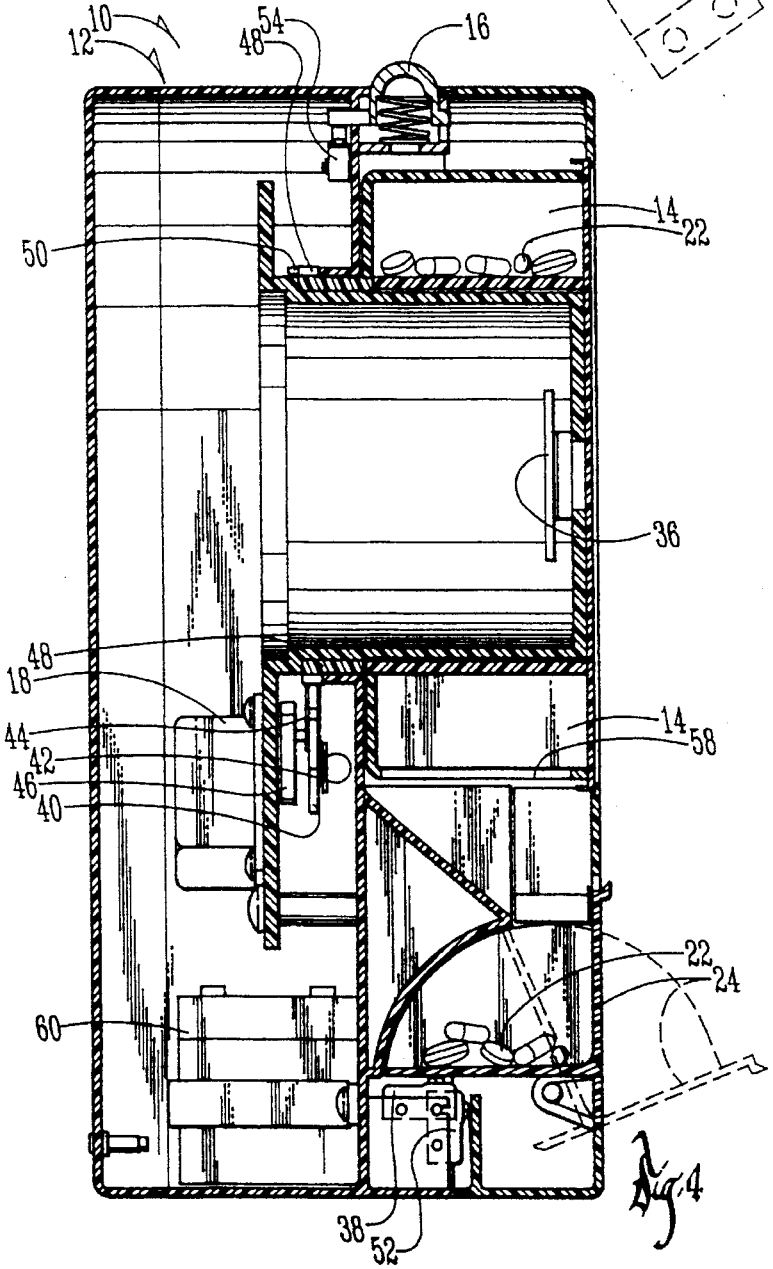
FIG. 4 shows a side view cross-section of the medication dispensing and monitoring device of the present invention.
Figures 4, 5:
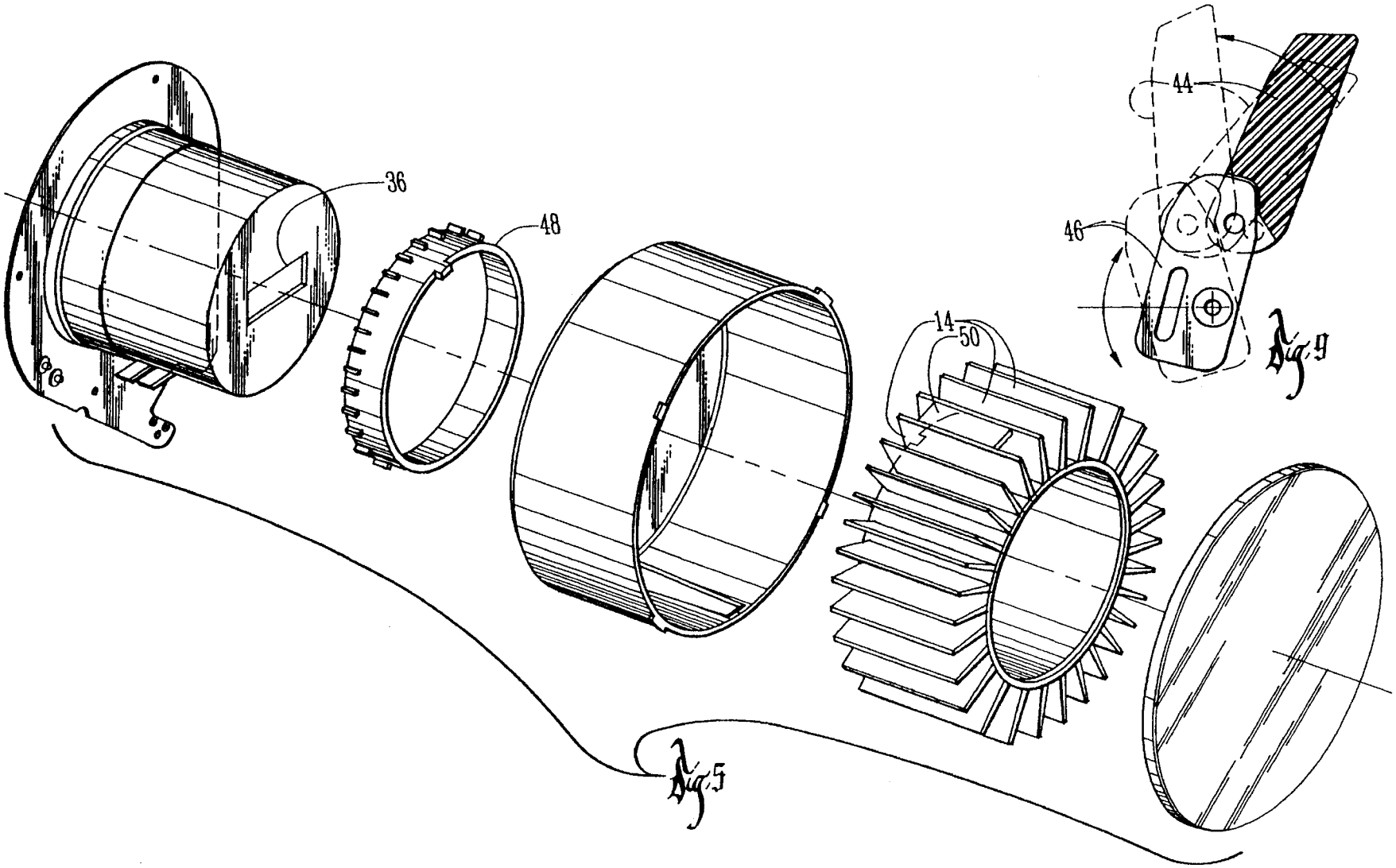
FIG. 5 shows an exploded view of the pill dispensing compartments of the present invention.

As shown in FIG. 5, the pill dispensing compartments include a home indicator 50 coupled to one of the compartments. As shown in FIG. 2, a micro switch 56 is used to sense the presence of the home indicator 50 telling the processor when the pill dispensing compartment assembly is in the "home" position. In this way, the processor will always know what position the pill dispensing compartment assembly is in. Also shown in FIG. 5 is a pill dispensing aperature 58 When the servo mechanism 18 rotates the pill dispensing compartments 14, one of the pill dispensing compartments will become exposed to pill dispensing aperature 58, causing the medication within the pill dispensing compartment 14 to drop through the aperture 58 into the tray 24.

The pills 22 are received by a medication dispensing tray 24 located below the carousel in front of the housing 12 where they are accessible to the patient. The patient will be signaled by an increased cadence tone of the audio alarm to open the medication dispensing tray 24 and remove the medication 22. The device includes a micro switch 38 connected to the processor which is activated when the patient opens or closes the medication dispensing tray. After the patient has opened the tray 24, a further increase in cadence tone signals the patient to close the tray 24.

Figure 10:
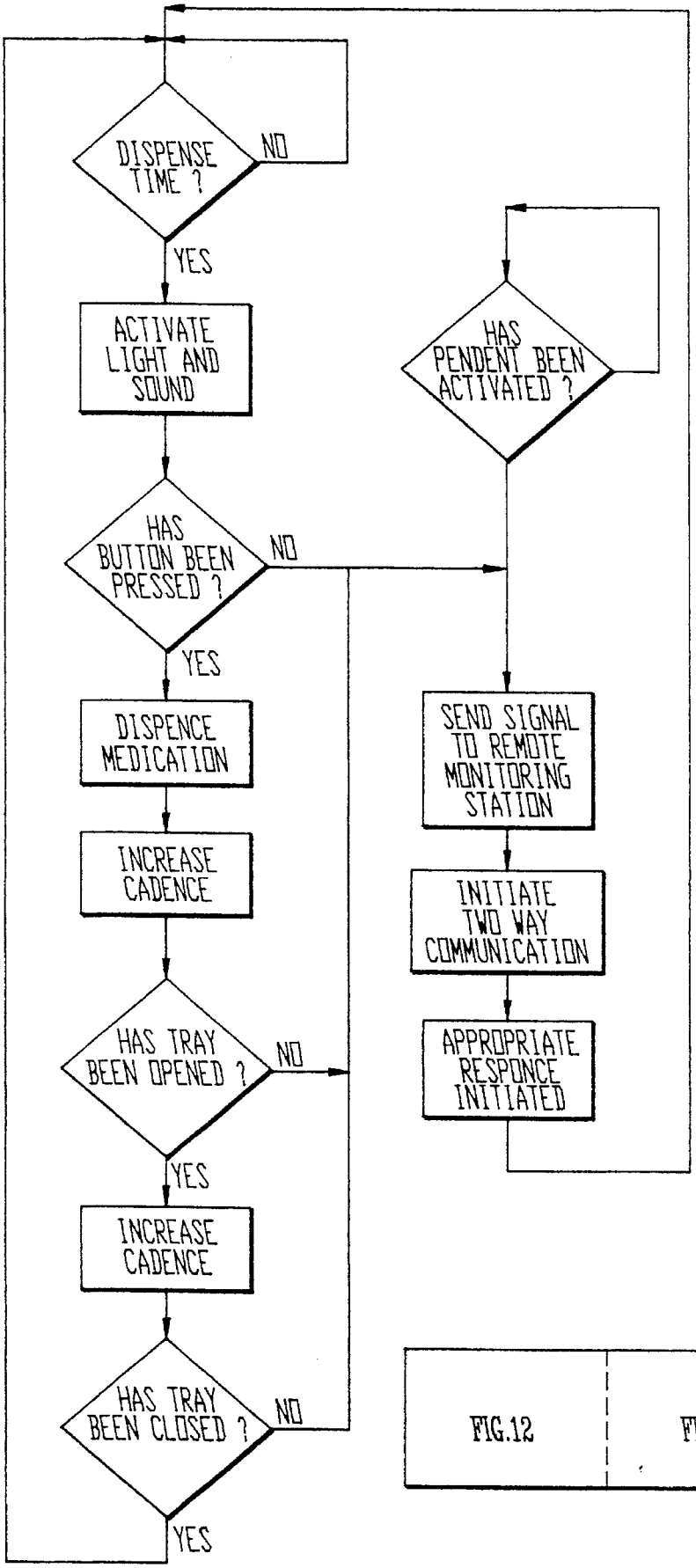
FIG. 10 shows a block diagram illustrating the operation the present invention.
Figure 11:
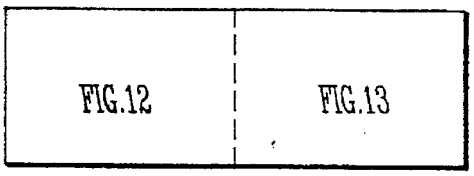
FIGS. 11–15 show electrical schematic diagrams of the present invention.

As illustrated in FIG. 10, if for some reason the patient fails to follow each of these steps, the device of the present invention initiates communications with a central monitoring station specifically indicating which stage the procedure is at and which steps the patient has failed to complete allowing an appropriate response to be initiated. This response may be from a care giver, medical personnel or emergency services. After a signal has been transmitted to the monitoring center, the device facilitates two-way hands-free communication between the patient and emergency personnel via a speaker phone which is a integral part of the medication dispensing and monitoring system. The speaker phone utilizes speaker 20 and microphone 26, both located on the front of housing 12.

The present invention also includes a pendant sized RF radio transmitter 28 which can be worn by the patient like a necklace. The housing of the device 12 includes an RF receiver for receiving signals from the pendant transmitter 28. In case of an emergency, the patient has the capability of pressing a button 30 on the pendant 28 sending a radio signal to the device which causes the device to signal the central monitoring center that an emergency has occurred. The device then allows the patient to have two-way voice communication with the monitoring center personnel.

In its preferred embodiment, the RF transmitter 28 is an off-the-shelf Miniature Pendant Transmitter ET-2 manufactured by Linear Corporation of Carlsbad, Calif. The ET-2 is a digitally coded miniature radio transmitter. The receiver used in the device is a corresponding Linear digital receiver.

The receiver is tuned to the same frequency as the ET-2 transmitter 28. The ET-2 is powered by a self-contained 12-volt battery and includes a battery test/operation LED. Any equivalent transmitter/receiver could also be used with the device.

Figure 12:
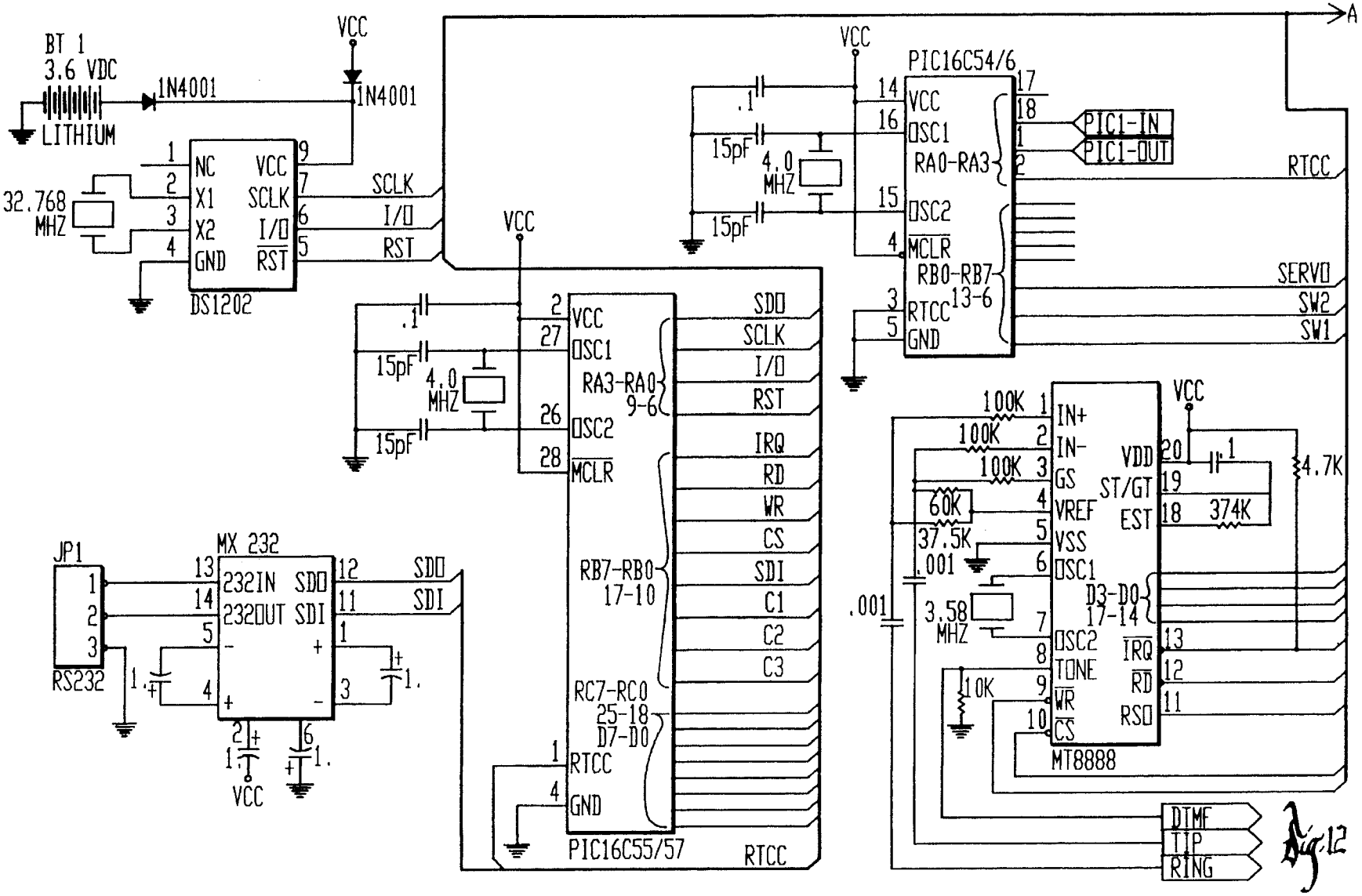

The medication dispensing and monitoring device 10 of the present invention utilizes two microcontroller chips to perform the various functions of the device. FIG. 12 shows an electrical schematic diagram of the two microprocessors and the other related compounds. A first microprocessor is dedicated to the servo mechanism control which activates the pill dispensing compartments 14 and causes them to dispense the medication 22. The preferred microprocessor has the part number PIC16C54/XT and is manufactured by Micro-Chip Technologies. The first microprocessor has 512×12 bytes EPROM and 32 ×8 RAM with 13 I/O lines. A second microprocessor is used to manage the display 36, communication routines, and the timing of the device. In the preferred embodiment, the second microprocessor has the part number PIC16C57/XT and is also manufactured by Micro-Chip Technologies. The second microprocessor has a 2K×12 bytes EPROM and 80×8 RAM with 21 I/O lines. The memory used in the preferred embodiment is nonvolatile memory, so a power failure will not affect the memory.

The medication dispensing and monitoring device 10 is programmable either remotely or directly. To program the device 10 remotely, a remote computer is connected to the device through the telephone lines and the device's communication line interface. To program the device 10 directly, a computer is connected to the device directly using the RS232 serial port. This gives great flexibility when programming or reprogramming the device.

None of the microprocessors have a conventional bus architecture, so eight of the I/O lines from the second processor are used to generate a non-conventional bus. To expand this bus and utilize all of the functions required for the present device, the capability of the I/O lines are expanded by using two 74HC573 octal three-state non-inverting transparent latches. This facilitates expansion to sixteen output lines. To expand the bus even further a 74HC541 octal three-state non-inverting buffer/line driver/line receiver is used to expand to eight input lines. The device also utilizes a battery backed up clock and 24 bytes of RAM. This keeps an accurate time base and stores the settings programmed into the unit.

Figure 13:
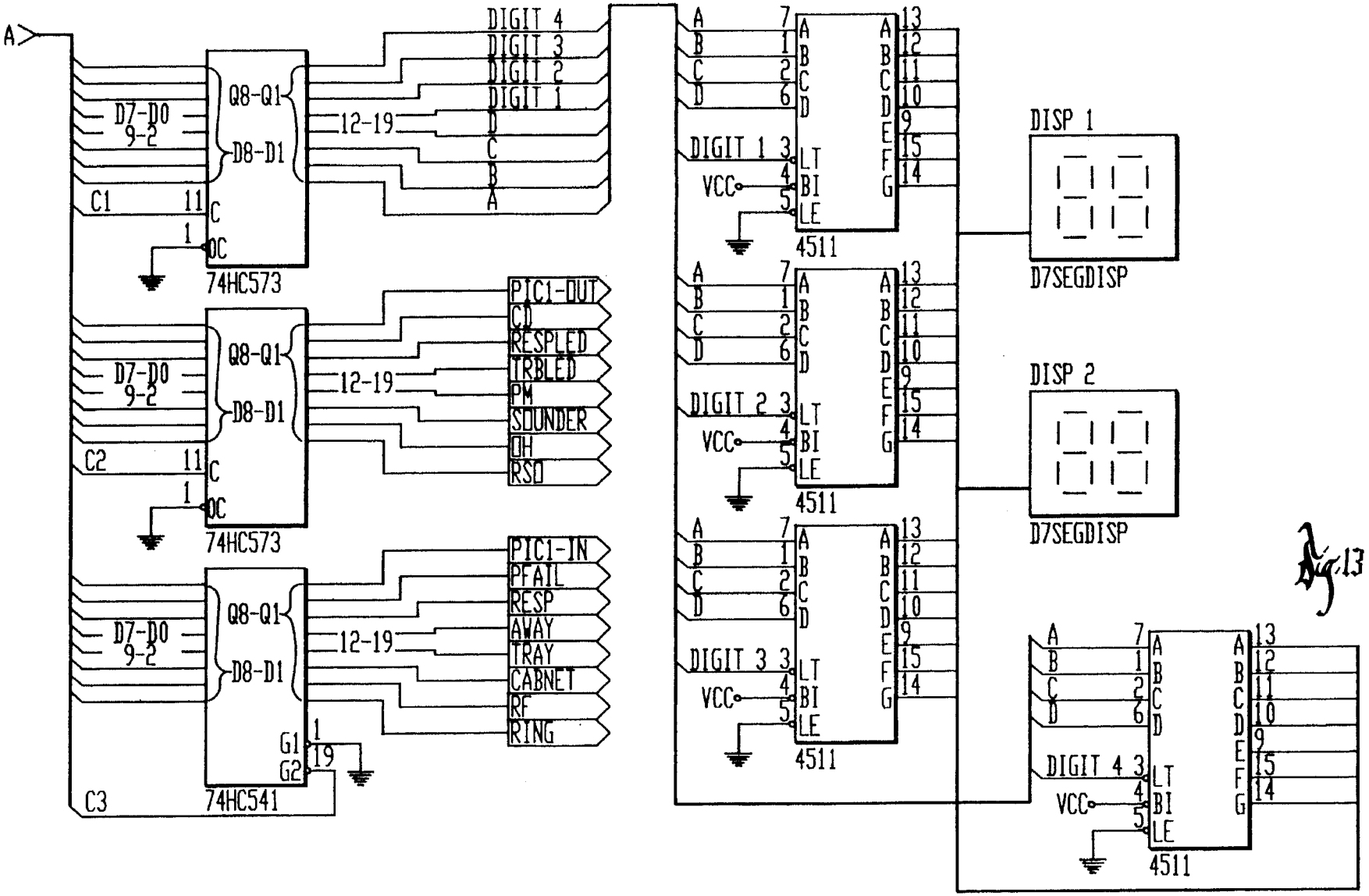
Figure 14:
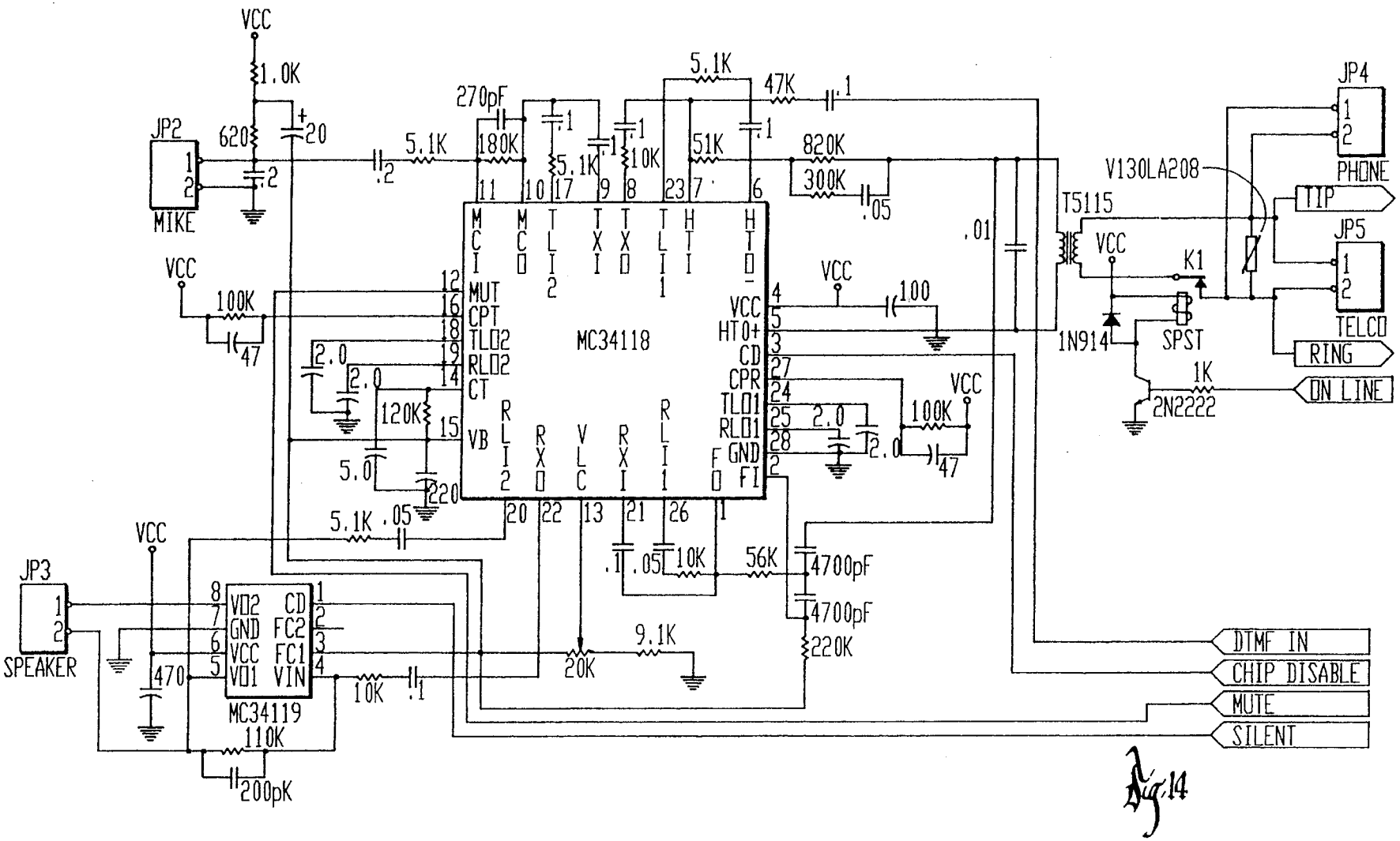

As shown in FIG. 1, the device includes a digital display 36 on the front of the housing 12. The display 36 can show the time or any other information. The PIC16C57/XT microprocessor controls the display 36 via four display drivers shown in FIG. 13. In the preferred embodiment, the display 36 is made up of two common cathode dual digit, seven segment displays with the part numbers D7SEGDISP. Each digit is driven by a display driver having the part number 4511.

Communications between the present invention and a central monitoring center is done with dual tone modulated frequency (DTMF). In the preferred embodiment, a DTMF transceiver with the part number MT8888 manufactured by Teletone is used. The transceiver acts as an interface between the device and the phone line. Direct communication between the device and a computer is accomplished using the RS232 serial port shown in FIG. 12. The present invention also has the capability of voice to voice communications through the use of a speaker phone chip, preferably part number MC34118 manufactured by Motorola. The speaker phone chip is connected to a phone jack, the microphone 26 and the speaker 20.

Other features of the present invention include a home/away switch 32 and a tamper-proof lock 34 for prescription security. FIG. 1 shows a switch 32 on the left side of the housing 12 with two positions, "home" and "away". When the switch 32 is in the "home" position, the device 10 operates normally as described above. When the switch 32 is in the "away" position, the device 10 stops dispensing medication. This is used when the patient is away from home. The tamper-proof lock 34 as shown in FIG. 1 is also located on the left side of the housing. The lock 34 helps to insure the security of the prescription medication. The present invention also includes a micro switch 52 which is activated whenever the medication dispensing and monitoring device is opened.

Figure 15:
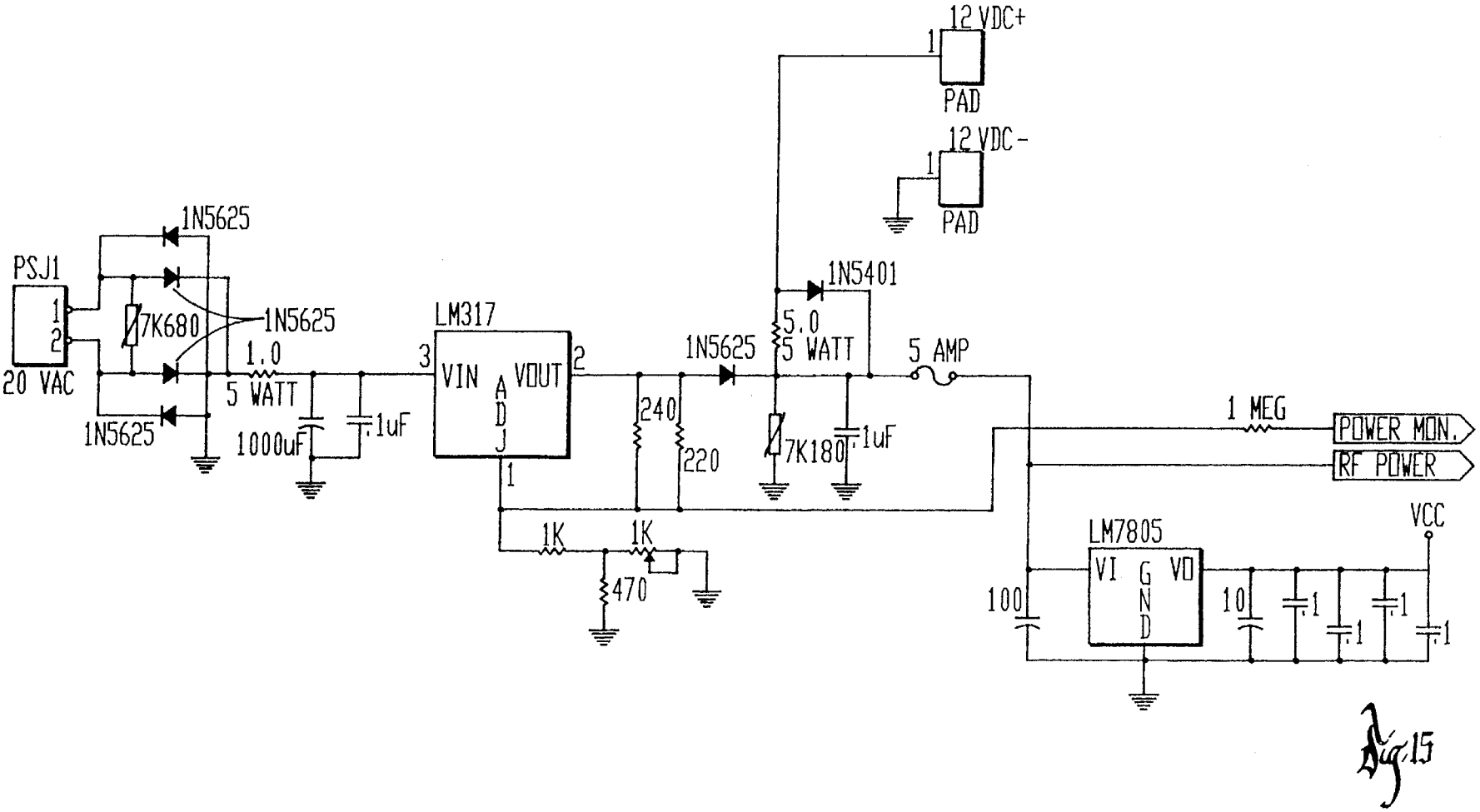

As shown in FIG. 15, the device is powered by a 24V DC Class II power supply and an internal 12V DC battery back-up system 60 with an internal battery charger for use when the primary power fails. The device also has a lithium battery back-up for a time-based chip, preferably part number DS1202 manufactured by Dallas Semiconductor, The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

What is claimed is:

1. A medication dispensing and monitoring system comprising: a housing;

a plurality of pill dispensing compartments coupled to said housing;

a servo mechanism operatively coupled to said pill dispensing compartments;

a processor, said processor electrically coupled to said servo mechanism for dispensing a predetermined amount of medication from at least one of said pill dispensing compartments at a predetermined time;

a radio receiver electrically coupled to said processor; and a communication-line interface operatively coupled to said processor for communication with a remote device.

2. The medication dispensing and monitoring system of claim 1 wherein said communication line interface is a telephone line interface.

3. The medication dispensing and monitoring system of claim 1 wherein said communication line interface is a computer port interface.

4. The medication dispensing and monitoring system of claim 1 wherein said plurality of pill dispensing compartments is comprised of 31 ill dispensing compartments.

5. The medication dispensing and monitoring system of claim 1 further comprising:

a remote radio transmitter capable of transmitting signals to said receiver.

6. The medication dispensing and monitoring system of claim 5 wherein said radio transmitter is a digitally coded miniature pendant transmitter.

7. The medication dispensing and monitoring system of claim 2 further comprising a built in telephone coupled to said communication interface.

8. The medication dispensing and monitoring system of claim 7 wherein said telephone is a speaker phone.

9. The medication dispensing and monitoring system of claim 1 wherein said pill dispensing compartments are arranged along a generally vertical plane.

10. The medication dispensing and monitoring system of claim 1 further comprising:

a medication tray for receiving medication from said pill dispensing compartments when said servo mechanism is activated;

a sensor operatively coupled to said medication tray for sensing when said medication tray is manipulated by the patient;

an alarm operatively coupled to said sensor and said processor, said alarm being activated after a predetermined amount of time if said pill dispensing compartments dispense medicine and said sensor does not sense that said medication tray has been manipulated.

11. The medication dispensing monitoring system of claim 10 wherein said alarm is visual.

12. The medication dispensing and monitoring system of claim 10 wherein said alarm is audible.

13. The medication dispensing and monitoring system of claim 10 wherein a signal is sent through said communication line interface after a predetermined amount of time if said medication is dispensed and said sensor does not sense that said medication tray has been manipulated.

14. The medication dispensing and monitoring system of claim 1 further comprising a display coupled to said housing and said processor for displaying information.

15. The medication dispensing and monitoring system of claim 1 further comprising a home/away switch coupled to said housing for interrupting the medication dispensing procedure.

16. The medication dispensing and monitoring system of claim 1 further comprising a lock coupled to said housing for securing said medication within said system.

17. The medication dispensing and monitoring system of claim 1 further comprising:

a medication tray for receiving medication from said pill dispensing compartments when said servo mechanism is activated;

a sensor operatively coupled to said medication tray for sensing when said medication tray is manipulated by the patient;

an alarm operatively coupled to said sensor and said processor, said alarm being activated after a predetermined amount of time if said pill dispensing compartments dispense medicine and said sensor does not sense that said medication tray has been manipulated.

18. The medication dispensing and monitoring system of claim 17 wherein a signal is sent through said communication line interface after a predetermined amount of time if said medication is dispensed and said sensor does not sense that said medication tray has been manipulated.

19. A method of dispensing and monitoring medication to a patient comprising the steps of:

providing a housing including a plurality of pill dispensing compartments;

filing at least one of said pill dispensing compartments with a predetermined amount of medication;

dispensing each of said predetermined amount of medication at predetermined times;

sensing whether the patient has acknowledged that medication was dispensed;

activating an alarm if the patient fails to acknowledge that said medication was dispensed;

sending a signal to a remote monitoring center if the patient fails to acknowledge that said medication was dispensed.

20. The method of claim 19 further comprising the step of providing two-way hands-free communication between the patient and emergency personnel when said signal is sent to the remote monitoring center.

21. The method of claim 19 further comprising the steps of:

providing a processor operatively coupled to said pill dispensing compartments; and programming said processor to dispense said medication at said predetermined times.

22. The method of claim 19 further comprising the steps of:

providing a radio receiver within said housing; and providing a remote radio transmitter for sending a radio signal to said radio receiver when activated by a patient.

23. A medication dispensing and monitoring system comprising:

a housing;

a plurality of pill dispensing compartments coupled to said housing;

a servo mechanism operatively coupled to said pill dispensing compartments;

a processor, said processor electrically coupled to said servo mechanism for dispensing and monitoring a predetermined amount of medication from at least one of said pill dispensing compartments at a predetermined time; and a communication-line interface operatively coupled to said processor for communication with a remote device, said communication being initiated by said processor based on said monitoring of the dispensed medication.

24. The medication dispensing and monitoring system of claim 23 further comprising:

a radio receiver electrically coupled to said processor; and a remote radio transmitter capable of transmitting signals to said receiver.

25. The medication dispensing monitoring system of claim 24 wherein said radio transmitter is a digitally coded miniature pendant transmitter.

* * * * *